US005895316A

United States Patent [19]

Williams

[11] Patent Number: 5,895,316

[45] Date of Patent: Apr. 20, 1999

[54] DRY-WALL CORNER SANDER

[76] Inventor: John W. Williams, 35066 Avenue H, Yucaipa, Calif. 92399

[21] Appl. No.: 08/707,309

[22] Filed: Sep. 3, 1996

[51] Int. Cl.[6] ..... B24D 15/00

[52] U.S. Cl. ..... 451/524; 451/523

[58] Field of Search ..... 15/244.1, 244.2, 15/144.1, 144.2, 229.13; 451/354, 523, 524

[56] References Cited

U.S. PATENT DOCUMENTS 5,690,547 11/1997 Holland, Jr. et al. ..... 451/524

*Primary Examiner*—Timothy V. Eley
*Assistant Examiner*—Derris Holt Banks
*Attorney, Agent, or Firm*—William H. Maxwell

[57] ABSTRACT

A sanding tool for out-of reach rounded corner dry-wall construction and comprised of a depressible pad having a coextensive angular cross section with an abrasive concavely rounded center section and preferably non-abrasive oppositely projecting obtusely related planar side sections to overlie oppositely projecting planar dry-wall surfaces, and a manipulatable adapter to be carried by an extension pole and coupled thereto by frictionally controlled swivel means for adjustably restrained reciprocal and rocking motion and releasable attachment of the sanding tool pad to said adapter.

3 Claims, 3 Drawing Sheets

C
T
A
39
40
41
47
45
43
46
W 17
12
W
10
20°
T
C
A
39
15
16
41
43
42
B
14
11
13
18
W
P
T
A 3
33
39
40
41
47
3
45
46
B
P

DRY-WALL CORNER SANDER

BACKGROUND OF THE INVENTION

This invention relates to dry-wall construction, and specifically to the uniform blending of corners with the oppositely continuing planar surfaces of adjoining walls. That is, it is rounded corners that must be dressed by sanding so that the corner curvature fairs smoothly into the oppositely extending flat walls. And, it is the outside corners that are involved here, corners that are usually at 90°, and also corners for example at 45°. It is to be understood that the degree of angularity between next adjacent walls can vary as circumstances require.

The walls are vertical, as are the corners at which the dry-wall panels of gypsum board are angularly abutted. Accordingly, these angularly abutted corners must be completed in a uniform and acceptable manner before the paint and/or finish is applied. In practice, convexly radiused corner members are fastened in place to complete such corners, as shown herein, and which are troweled with a filler cement or paste that drys to a solid state subject to be finished as by sanding, which is the subject of this invention.

Heretofore, finish sanding of dry-wall corners has been a cautious if not difficult operation because of the inherent tendency of the sanding tool edge to cut into and permanently mark the dry-wall surface, the dry-wall surface being comprised of a low grade pulp paper. The soft gypsum core and soft paper surface are easily damaged by the abrasive edge of the sanding tool or cutting edge of heavy sandpaper or the like. When such cutting marks occur, the wall corner must be reconstructed or at least re-troweled and sanded again, all of which is time consuming and an added expense. Accordingly, it is an object of this invention to avoid abusive sanding and to eliminate the probability of damaging sanding marks. With the present invention, the oppositely extending sanding planes of the tool are obtusely related with respect to the angle of the corner being sanded thereby. For example, obtuse with respect to a 90° corner, and also with respect to a 45° corner, or any other corner angle as circumstance may require.

Sanding tools of the type under consideration have been provided with extension poles in order to sand out of reach heights. These tools have been swivel mounted to the top end of the poles so as to be free to assume angular positions with repsect to said poles. In other words, the sanding tools have been gimbal mounted at the end of the poles, and which mounting has been found to be detrimental to the tool function of sanding. Firstly, before application to the wall surface the tool will fall into extreme positions incompatible with the wall surfaces. Secondly and of unobvious importance, when the tool is in place over the corner to be sanded, the loose gimbaled mounting of the prior art tools precludes control thereof by the pole. However, with the present invention, it is an object to control the sanding tool by rocking it into the desired position responsive to manual positioning of the pole. Accordingly, the gimbaled mounting of the sanding tool at the end of the pole is frictionally adjustable, a ball and socket joint or right angular pivotal axes as shown herein.

It is an object of this invention to provide an adapter for recieving a corner sanding tool having the angular features referred to, whereby sanding tools of preferred angularity can be mounted for dressing wall corners of certain angles, 90° or 45° or any other angle. In practice, the opposite sides of the sanding tool deviate approximately 15° from the planar surface of the continuing wall plane. This obtuse angularity separates the outer edge of the tool surface from either continuing wall, while the radius of the corner member remains uniform, for example a ¾ inch radius. In accordance with this invention , the sanding element is backed by a firm padding carried by a rigid body conforming to the aforesaid corner radius and to the angularity of the corner to be rounded, for example, concentric with a ¾ inch corner radius and opposite sides divergent at 120°, for dressing a 90° corner. It is an object of this invention to provide an adapter to receive the aforesaid tool, whether it be a 90° or a 45° or any other angle of sanding tool. It is still another object to provide a replaceable sanding tool that is releasably applied to said adapter gimbaled at the end of a pole that is adapted to control said sanding tool. In practice, the body of the sanding tool is held to the adapter by self threading screw fasteners, or by means of darts.

The foregoing and various other objects and features of this invention will be apparent and fully understood from the following detailed description of the typical preferred forms and applications thereof, throughout which description reference is made to the accompanying drawings.

THE DRAWINGS

PREFERRED EMBODIMENT

Figures 1, 2, 3:
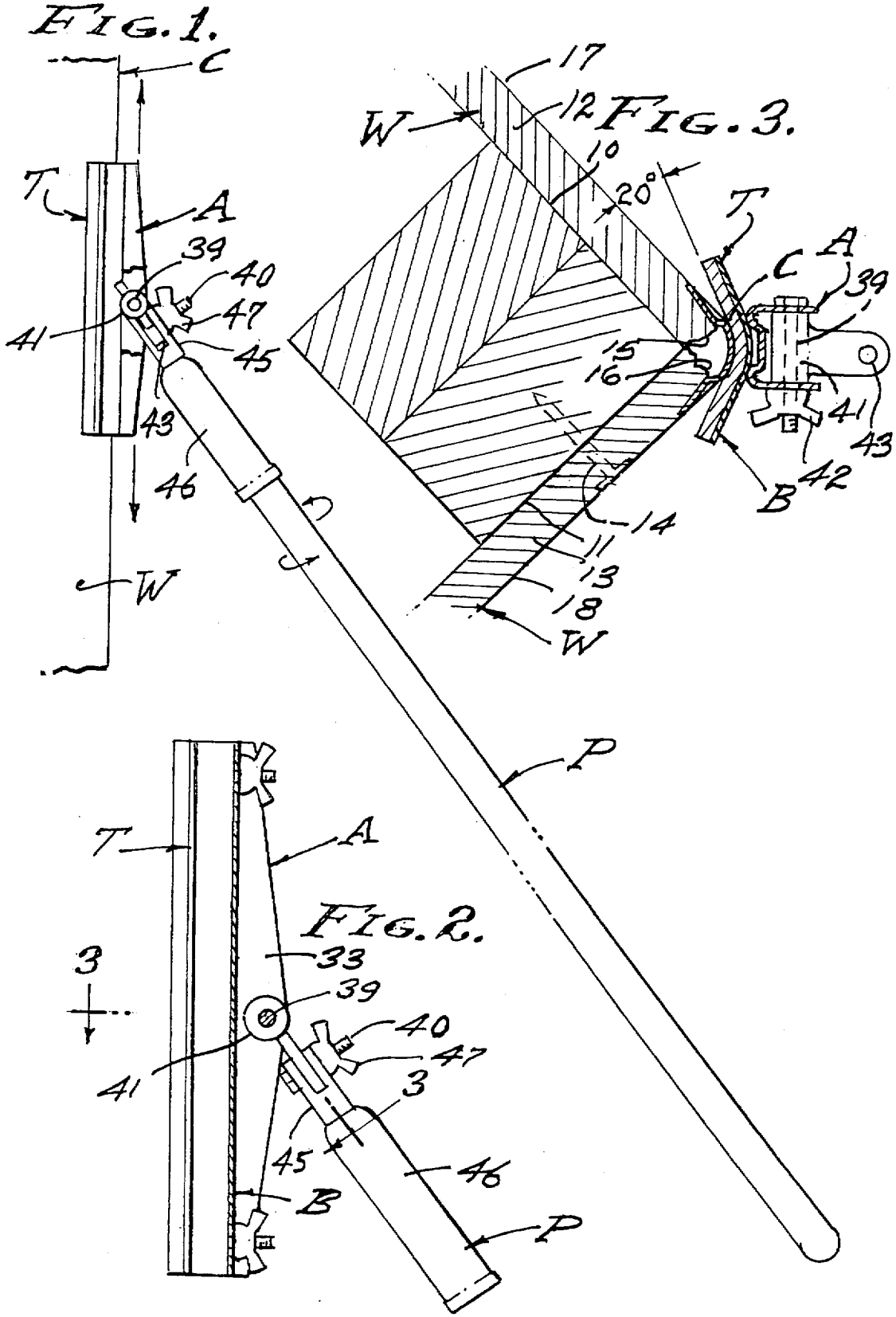
FIG. 1 is an elevation view at a corner of dry-wall construction, illustrating the corner sander in operation.
FIG. 2 is a side elevation view of the corner sander and its attachment to a manipulating pole
FIG. 3 is a sectional view taken as indicated by line 3—3 on FIG. 2 and showing the releasable attachment of the sanding tool to the positionable adapter.

Referring now to the drawings, the Sander is comprised of a sanding tool T and an adapter A frictionally gimbaled to the outer end of a manipulatable pole P, novelty residing in the sanding tool as an article and in the adaptable and adjustable control of the sanding tool which can be advantageously manipulated by the pole.

FIG. 1 of the drawings illustrates the operational relationship of the sanding tool T applied to the adapter A and frictionally gimbaled to the pole P for elevated manipulation of said sanding tool. The corner member C of the walls W can be of any inclusive angle, the obtuse angle of the sanding tool T being selected accordingly, as will be described. Motion of the tool T is upward and downward as indicated by the arrows in FIG. 1 And, manipulation of the tool T is indicated by the rocking motion arrows in FIG. 1. In practice, said rocking motion is limited by manipulation of the pole, and frictional gimbaled attachment to the adapter, to prevent the opposite edges of the body B and sanding member S from digging into - continuing wall surfaces.

A typical 90° corner dry-wall construction is shown in FIG. 3 of the drawings, comprised of a pair of 2×4 inch studs forming a corner post with right angularly related oppositely extending walls W. Accordingly, there is a corner at the apex of post faces 10 and 11 to which the dry-wallboard panels 12 and 13 are attached as by nailing 14. In practice, the butt end 15 of panel 12 is coplanar with the post face 11, while the butt end 16 of panel 13 is coplanar with the post face 10. The characteristic feature to which this invention is applied is the rounded corner member C that joins the exterior planar surfaces 17 and 18. Corner member C is typically a sheet metal member having a 90° a concavo-convex center section 19 with oppositely extending flanges 20 and 21 for securement to the continuing planar wall surfaces 17 and 18. The flanges 20 and 21 are joggled inwardly from and extend tangentially from the quarter-rounded center section 19, so as to receive troweled paste or "mud" compound that will be sanded. The corner member C is secured by cup-head nails (as shown) and a thin layer of compound is troweled over the joggled flanges and onto the planar surfaces 17 and 18 as indicated.

Figure 4:
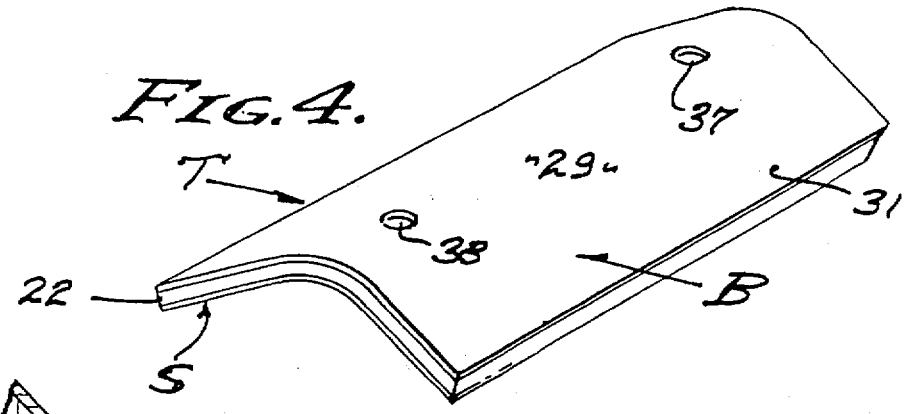
FIG. 4 is a perspective view of the sanding tool of the present invention.
Figure 5:
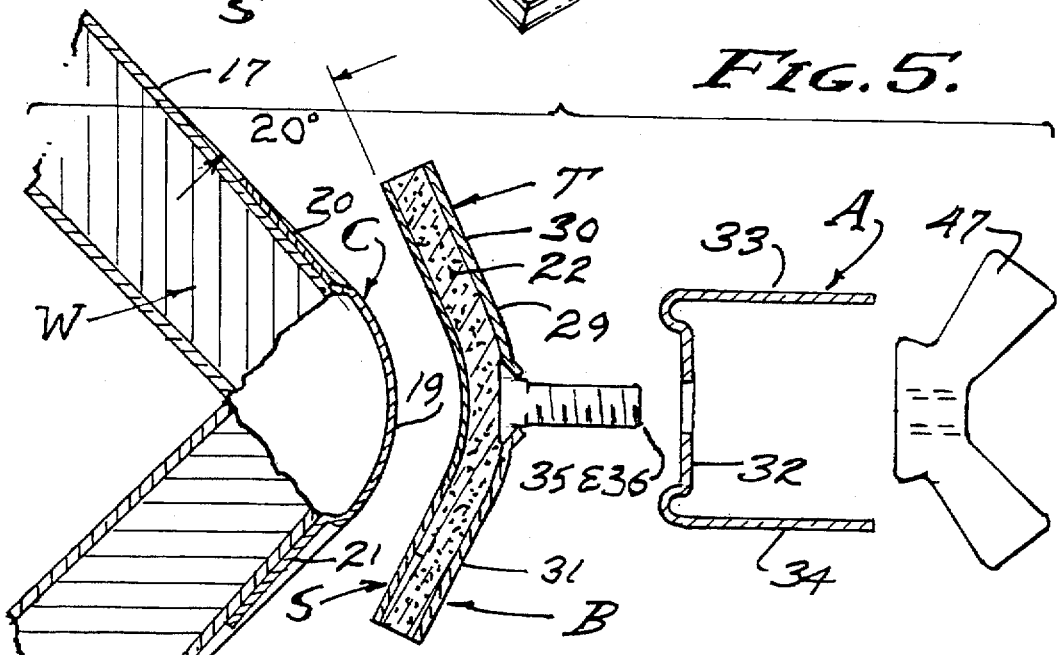
FIG. 5 is an enlarged detailed sectional view of a 90° sanding tool, being an exploded view showing the corner, the sanding tool and the adapter and self tapping screw for carrying the sanding tool.

The sanding tool T shown in FIG. 4 is formed to dress a 90° dry-wall corner as shown in FIGS. 3 and 5, and is comprised of an elongated body B of transversely angular cross section to which the sanding member S is laminated with an intermediate pad 22 of firm depressible material therebetween. The body B is rigid and preferably a durable thickness of metal such as mild steel or aluminum, so as to be substantially inflexible. The pad 22 is of a softness to conform to irregularities in the surface to be rounded by sanding and is preferably formed of a plastic of compressible open cells, so as to be sponge-like and resilient to its original form and/or thickness. In practice, the pad 22 is ⅛ to ¼ inch thick or as may be required. The sanding member S is an abrasive layer or the like and of course or fine grit as may be required. And, the sanding member can be a paper or cloth backed fabrication, or an abrasive surface applied directly to the foamed body of the pad 22.

Referring now to FIGS. 3 and 5, the corner member C is installed in its originally intended 90° configuration , in which case the corner section 19 has a radius to accomodate the dry-wallboard to which it is attached, for example a ¾ inch radius for attachment to ¾ inch dry-wallboard. Accordingly, the body B is comprised of a center section 29 having a concavo-convex radius equal to the ¾ inch convex radius plus the thickness of the pad 22, for example a 3/16 inch pad thickness and a body radius of 13/16 inch. Therefore, the concaved radius of the sanding member S is substantially the same as the convex radius of the convex corner member C.

In accordance with this invention, the body B of the tool T is elongated with opposite planar side sections 30 and 31 integral with the center section 29 for overlying the oppositely extending flanges 20 and 21 of the corner member C. A feature of this invention is the obtuse relationship of the sections 30 and 31 with respect to the flanges 20 and 21, there being a substantial diversion in the angularity thereof as clearly shown in FIG. 5. In practice, the side sections 30 and 31 of the tool body B diverge obtusely from the opposite flanges 20 and 21 of the corner member C, by less than 20° as is shown. Therefore, the abrasive surfaces of the sanding member S separate from the planar surfaces 17 and 18 of the walls W, and do not contact the same unless deliberately manipulated to do so, as will be described. Consequently, the walls W cannot be accidentally gouged by the edges of the sanding member S.

Figure 6:
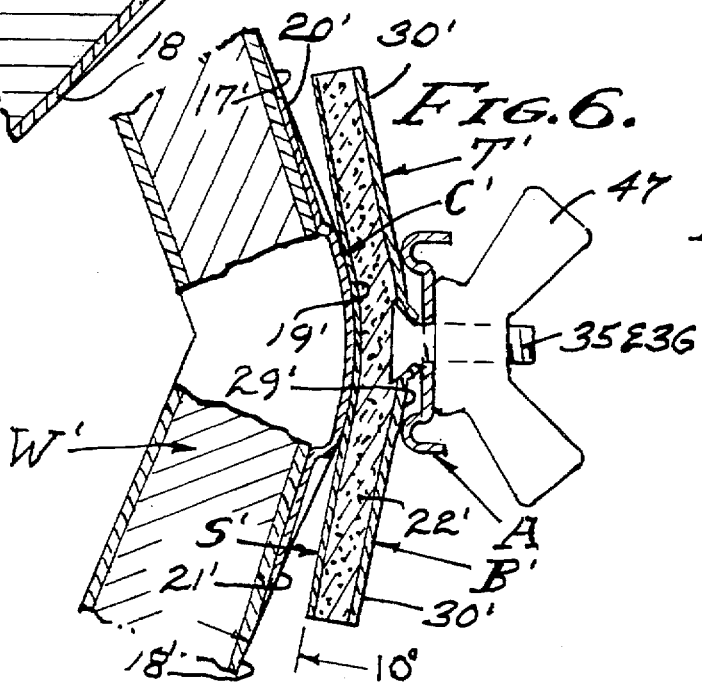
FIG. 6 is an enlarged detailed sectional view of a 45° sanding tool and adapter assembly, showing the 160° corner and sanding tool applied thereto.

Referring now to FIG. 6, the corner C' is opened up angularly and installed in a modified 160° corner condition to accommodate a 45° dry-wall construction having an included angle of 135°; in which case the corner section 19' has an increased radius of approximately 1½ inches. Accordingy, the corner section 19' has a commensurately increased radius to accommodate the dry-wallboard to which it is attached. And, the body B' has an increased center section 29' radius of approximately 1 11/16 inch and the concaved radius of the sanding member S' is substantially the sams as the radius of the expanded convex corner member C'.

A feature of this invention is the obtuse relationship of the sections 30' and 31' with respect to the divergently expanded flanges 20' and 21', there being a substantial divergence in the angularity thereof as clearly shown in FIG. 6 of the drawings. In practice, each side section 30' and 31' of the tool body B' diverge obtusely from the opposite flanges 20' and 21' of the expanded corner member C' by more than 5° to 12½° as is shown. Therefore the abrasive surfaces of the sanding member S separate from the planar surfaces 17' and 18' of the walls W' and do not contact the same unless deliberately manipulated to do so, as will be described. Consequently, the walls W' cannot be accidentally gouged by the edges of the sanding member S'.

In accordance with this invention, a manipulatable adapter A is provided to controllably rock the sanding tool T while reciprocating it along the corner member C or C' that joins the dry-wallboard panels. The adapter A couples the tool T to a manipulating pole P as shown in FIGS. 1 through 7, and is a mounting channel comprised of a base 32 and parallel upstanding side rails 33 and 34. The base 32 is coextensive in length with the body B (B') of the sanding tool and overlies the center section 29 (29') with clearance. A feature is the re-curved joinder of the side rails to the base of the channel, establishing said clearance when the spaced rails engage the convex surface of the body section 29 (29') (see FIGS. 5 and 6).

Figure 7:
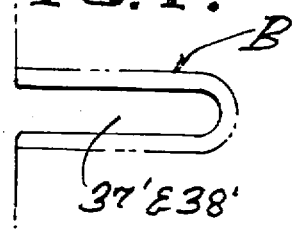
FIG. 7 is a plan view of one end of the sanding tool of FIG. 4, illustrating a slotted opening for the insertion of a fastener.

Securement of the adapter A channel to the sanding tool T is by means of spaced screw fasteners 35 and 36 engaged in correspondingly spaced holes 37 and 38 through the center section 29 (29') of the body B (B') of the sanding tool and secured by wing nuts 47. In FIG. 7, slots 37' and 38' are provided to slideably receive the fasteners 35 and 36 with the heads thereof buried in the pad 22 as shown in FIG. 6. Accordingly, the sanding tool T is replaceable with facility by the use of screw fasteners 35 and 36 secured by wing nuts 47 or the like.

Coupling of the adapter A to the manipulating pole P is by swivel means, whereby turning of the pole P controls rocking motion of the adapter A and sanding tool T attached thereto. Accordingy, there is a transverse axis established by a pivot pin 39 parallel to the base 37 and extending through the side rails of the adapter channel. And, there is a cross axis established by a pivot pin 40 normal to and/or at a right angle to the pin 39 axis (see FIGS. 2 and 3). As a result of these crossed pivotal axes, the extended longitudinal axes of the pole P can swing to and from the adapter A on the pin 39 axis, and can swing from side to side on the pin 40 axis, all as circumstances require.

A feature of this invention which provides control is the adjustable frictional restraint against swinging of the pole P about the axes of pins 39 and 40. As shown, there is a cross fitting 41 that extends between and frictionally engages with the inside faces of the rails 33 and 34, there being a head on the pin 39 for tensioned adjustment by a wing-nut for controlling the frictional restraint against angular to and from displacement of the pole P from the tool T. In practice, adjusted restraint on the transverse axis of pin 39 in minimal, or in other words, loose. And there is a tongue 43 of the cross fitting that extends in a plane coincidental with the pin 39 axis and through a pivotal opening to project through a clevis 45 on the cross axis at the base of a socket 46 that carries the pole P, there being a head on the pin 40 for tensioned adjustment by a wing-nut 47 for controlling the frictional restraint against angular side to side displacement of the pole P from the tool T. In practice, adjusted restraint on the cross axis of pin 40 is substantial, or in other words snug, in order to gain manual control over the sanding tool T.

Figure 8:
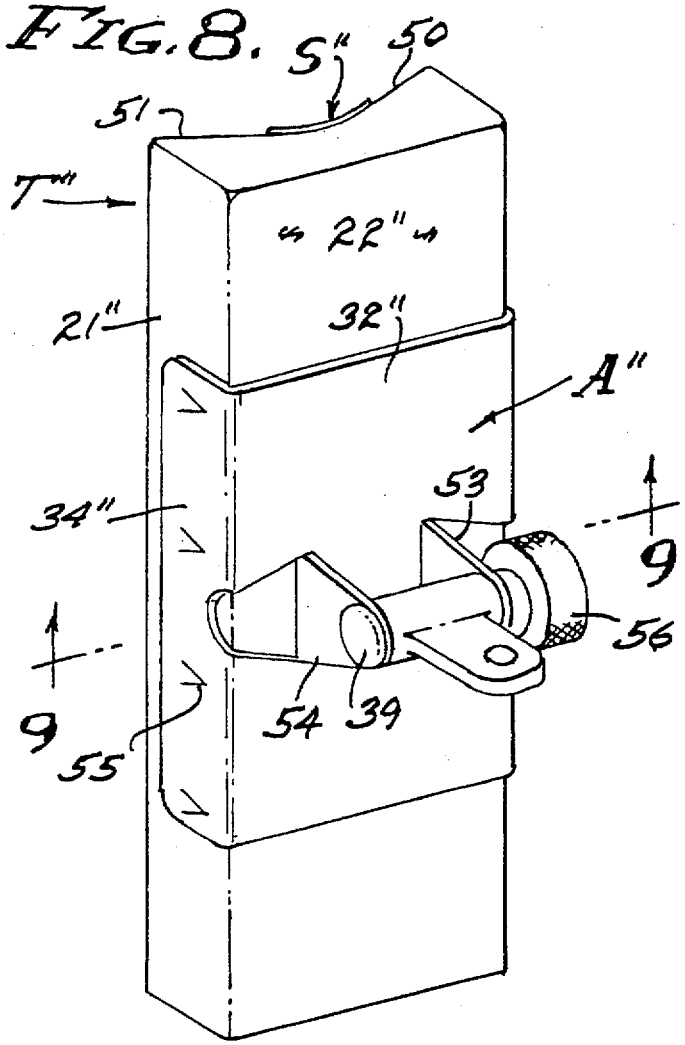
FIG. 8 is a perspective view of a preferred embodiment.

Referring now to the sanding tool T" shown in FIGS. 8 and 9 of the drawings, the hereinabove described body B is eliminated and replaced by a pad 22" of firm substantially rigid depressible material to which the sanding member S" is laminated. The pad 22" is a block of suitable rigidity so as to retain its straight elongate form, and of a softness to conform to irregularities in the surface to be rounded by sanding and preferably of sponge-like open cell foamed plastic that is compressible and resilient. In practice, the pad 22" is 1 inch thick, 2¾ inches wide, and 9 inches long (essentially a rectangular solid of right angular form).

The sanding member S" is an abrasive layer or the like and of course or fine grit as may be requried. And, the sanding member can be a paper or cloth backed fabrication, or abrasive surface applied directly to the foamed body of the pad 22". Accordingly, pad 22" is comprised of a bottom center section having an elongated concaved radius conforming to the convex radius of the corner member C (C'). The concaved radius of the laminated sanding member S" is substantially the same as the convex radius of the corner member with its side sections 50 and 51 for overlying the oppositely extending flanges 20 and 21 (20' and 21') of the corner member C (C'). A feature of this invention is the obtuse relationship of the sections 50 and 51 with respect to the flanges 20 and 21, there being a substantial diversion in the angularity thereof, as clearly shown in FIG. 9. In practice, the side sections 50 and 51 of the pad 20" diverge obtusely from the opposite flanges of the corner C (C'), for example a 90° corner, by 15° as is shown.

Figure 9:
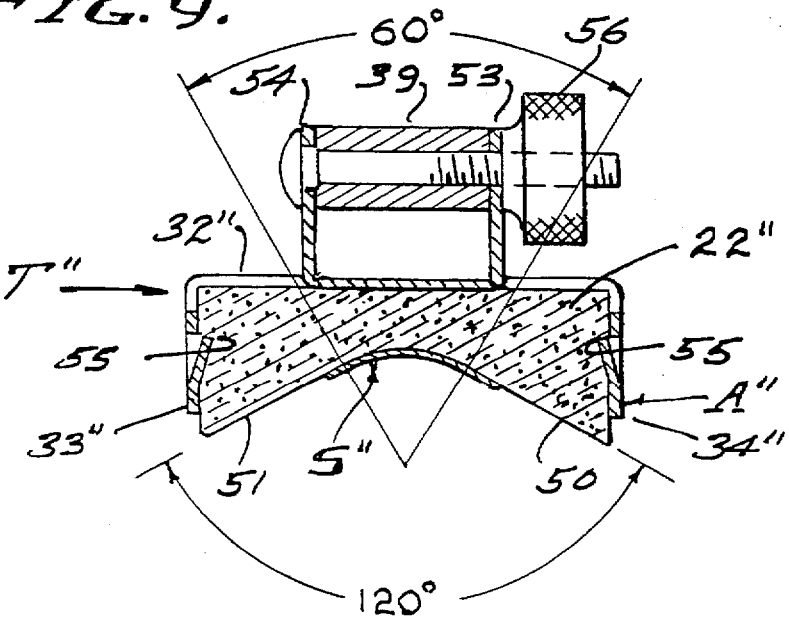
FIG. 9 is view taken as indicated by line 9—9 on FIG. 8.

Referring now to FIG. 9 of the drawings, the sanding member S" has an arcuate cross section less than the arcuate center section 19 (19') if the corner member C (C'). As shown, the A" cross section is at least 60° and as much as 80°, which permits tilting of the sanding tool T" in order to dress the entire corner C (C') without abrasively contacting surfaces 20 (20') and 21 (21'). Therefore, the non-abrasive surfaces 50 and 51 of the pad 22" separate from the planar surfaces of the walls and do not contact the same unless deliberately manipulated to do so. Consequently, the walls cannot be accidentally gouged by the planar sides 50 and 51 of the sanding tool T". That is, the side edges of the sanding member S" cannot reach over the flat wall surfaces.

In accordance with this invention, a manipulatable adapter A" is provided to controllably rock the sanding tool T" while resiprocating it along the corner member C (C') that joins the dry-wallboard panels. The adapter A" couples the tool T" to a manipulatable pole P and in its preferred form is an inverted channel comprised of a base 32" and depending parallel side rails 33" and 34". In practice, the base 32" is shorter in length than the pad 22", leaving opposite ends of the substantially rigid pad free to flex as may be required. A feature is the progressive die blank and forming of the reversely depending side rails of the base and upstanding ear 53 and 54 to receive the pivot 39 (see FIGS. 8 and 9). Securement of the sanding pad 22" to the adapter A" is by means of spaced upwardly projecting inwardly turned pointed darts 55 that securely anchor the pad 22" in its working position. Accordingly, the sanding tool T" is manually replaceable without the need of tools or fasteners.

Adjustable coupling of the adapter A" to the manipulatable pole P is by swivel means as hereinabove described, whereby turning of the pole P controls rocking motion of the adapter A" and sanding tool T" attached thereto. Tensioned adjustment is by knurled nuts 56 for controlling the looseness or frictional restraint against angular displacement of the pole P and sanding tool T".

Having described only the preferred forms and applications of my invention, I do not wish to be limited or restricted to the specific details herein set forth, but wish to reserve to myself any modifications or variations that may appear to those skilled in the art as set forth within the limits of the following claims.

I claim:

1. An adjustably controllable corner sander for dry-wall construction having a corner member with a convexly rounded and arcuate center section and oppositely projecting angularly related flanges fastened to planar dry-wall surfaces continuing therefrom and troweled with a mud compound to be dressed by sanding, and including;

a sanding tool comprised of an elongated rigid and depressible pad having a coextensive transversely angular cross section comprised of an abrasive surfaced concavely rounded center section to abrasively overlie said convexly rounded center section of said corner member, and non-abrasive oppositely projecting angularly related planar side sections to overlie said oppositely projecting flanges of said corner member, the included angle between the oppositely projecting angularly related side sections of said pad being greater than the included angle between the oppositely projecting flanges of said corner member and planar dry-wall surfaces continuing therefrom, whereby said concaved center section of the pad can be rocked upon the first mentioned arcuate center section of the corner member, and a manipulatable adapter comprised of depending side rails engageable over the sanding tool pad, there being a fastener means comprised of at least one upwardly projecting dart turned inwardly from each side rail for releasable attachment of the sanding tool pad to said adapter channel.

2. An adjustably controllable corner sander for dressing out-of-reach dry-wall construction having a corner member with a convexly rounded and arcuate center section and oppositely projecting angularly related flanges fastened to planar dry-wall surfaces continuing therefrom and troweled with a mud compound to be dressed by sanding, and including;

a sanding tool comprised of an elongated rigid and depressible pad having a coextensive transversely angular cross section comprised of a concavely rounded center section with an abrasive surface to overlie said convexly rounded center section of said corner member, the arcuate extent of the abrasive surface being less than the arcuate extent of the convexly rounded and arcuate center section of the said corner member, whereby the said abrasive surface does not reach over said oppositely projecting flanges when the sanding tool is rocked, and non-abrasive oppositely projecting angularly planar side sections to overlie said oppositely projecting flanges of said corner member, the included angle between the oppositely projecting angularly related side sections of said pad being greater than the included angle between the oppositely projecting flanges of said corner member and planar dry-wall surfaces continuing therefrom, whereby said concaved center section of the pad can be rocked upon the first mentioned arcuate center section of the corner member, and a manipulatable adapter with manipulation means comprised of an extension pole coupled thereto by frictionally controlled swivel means for adjustably restrained reciprocal and rocking motion and having fastener means for releasable attachment of the sanding tool pad to said adapter.

3. An adjustably controllable corner sander for dressing out-of-reach dry-wall construction having a corner member with a convexly rounded and arcuate center section and oppositely projecting angularly related flanges fastened to planar dry-wall surfaces continuing therefrom and troweled with a mud compound to be dressed by sanding , and including;

a sanding tool comprised of an elongated rigid and depressible pad having a coextensive transversely angular cross section comprised of a convexly rounded center section with an abrasive surface to overlie said convexly rounded center section of said corner member, and non-abrasive oppositely projecting angularly planar side sections to overlie said oppositely projecting flanges of said corner member, the included angle between the oppositely projecting angularly related side sections of said pad being greater than the included angle between the oppositely projecting flanges of said corner member and planar dry-wall surfaces continuing therefrom, whereby said concaved center section of the pad can be rocked upon the first mentioned arcuate center section of the corner member, and a manipulatable adapter comprised of a channel with depending side rails engagable over the sanding tool pad, with manipulation means comprised of an extension pole coupled thereto by frictionally controlled swivel means for adjustably restrained reciprocal and rocking motion, and having fastener means comprised of at least one upwardly projecting dart turned inwardly from each side rail for releasable attachment of the sanding tool pad to said adapter.

* * * * *